US008684666B2

(12) United States Patent
Marra

(10) Patent No.: US 8,684,666 B2
(45) Date of Patent: Apr. 1, 2014

(54) LOW PRESSURE COOLING SEAL SYSTEM FOR A GAS TURBINE ENGINE

(75) Inventor: John J. Marra, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 513 days.

(21) Appl. No.: 13/084,618

(22) Filed: Apr. 12, 2011

(65) Prior Publication Data

US 2012/0263575 A1 Oct. 18, 2012

(51) Int. Cl.
*F01D 25/12* (2006.01)

(52) U.S. Cl.
USPC ..... 415/115; 415/199.5; 415/144

(58) Field of Classification Search
USPC ..... 415/115, 199.5, 144
See application file for complete search history.

(56) References Cited

U.S. PATENT DOCUMENTS 3,527,054 A 9/1970 Hemsworth
5,358,378 A * 10/1994 Holscher ..... 415/170.1
5,545,004 A * 8/1996 Ho et al. ..... 415/115
8,262,342 B2 * 9/2012 Morris et al. ..... 415/115
2009/0175732 A1 * 7/2009 Glasspoole et al. ..... 416/97 R
2010/0008760 A1 1/2010 Morris et al.
2010/0074732 A1 3/2010 Marra et al.

FOREIGN PATENT DOCUMENTS

DE 102009021384 A1 11/2010
EP 0704603 A2 4/1996

* cited by examiner

*Primary Examiner* — Ninh H Nguyen

(57) ABSTRACT

A low pressure cooling system for a turbine engine for directing cooling fluids at low pressure, such as at ambient pressure, through at least one cooling fluid supply channel and into a cooling fluid mixing chamber positioned immediately downstream from a row of turbine blades extending radially outward from a rotor assembly to prevent ingestion of hot gases into internal aspects of the rotor assembly. The low pressure cooling system may also include at least one bleed channel that may extend through the rotor assembly and exhaust cooling fluids into the cooling fluid mixing chamber to seal a gap between rotational turbine blades and a downstream, stationary turbine component. Use of ambient pressure cooling fluids by the low pressure cooling system results in tremendous efficiencies by eliminating the need for pressurized cooling fluids for sealing this gap.

20 Claims, 5 Drawing Sheets

LOW PRESSURE COOLING SEAL SYSTEM FOR A GAS TURBINE ENGINE

STATEMENT REGARDING FEDERALLY SPONSORED RESEARCH OR DEVELOPMENT

Development of this invention was supported in part by the United States Department of Energy, Advanced Turbine Development Program, Contract No. DE-FC26-05NT42644, H2 Advanced Hydrogen Turbine Development. Accordingly, the United States Government may have certain rights in this invention.

FIELD OF THE INVENTION

This invention is directed generally to turbine engines, and more particularly to sealing systems for low pressure cooling systems in turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades and turbine vanes must be made of materials capable of withstanding such high temperatures. Turbine blades, vanes and other components often contain cooling systems for prolonging the life of these items and reducing the likelihood of failure as a result of excessive temperatures.

Typically, turbine vanes extend radially inward from a vane carrier and terminate within close proximity of a rotor assembly, and turbine blades extend radially outward and terminate near ring segments. The turbine blades and vanes are formed into rows, referred to as stages. Pressurized cooling fluids are supplied to the blade and vane stages for cooling the blades and vanes to prevent damage and to prevent ingestion of the hot gases into internal aspects of the turbine engine. Typically, each stage is cooled with pressurized cooling fluids that are compressed with a compressor within the turbine engine. The work used to compress the cooling fluids is a loss to the turbine engine. Thus, a need exists for a more efficient cooling fluid feed system design for turbine blades to provide pressurized cooling fluids to enable turbine engine growth and increased operating range.

SUMMARY OF THE INVENTION

This invention relates to a low pressure cooling system for a turbine engine for directing cooling fluids at low pressure, such as generally at or near ambient pressure, through at least one cooling fluid supply channel and into a cooling fluid mixing chamber positioned immediately downstream from a row of turbine blades extending radially outward from a rotor assembly to prevent ingestion of hot gases into internal aspects of the rotor assembly. The low pressure cooling system may also include at least one bleed channel that may extend through the rotor assembly and exhaust cooling fluids into the cooling fluid mixing chamber to seal a gap between the rotational turbine blades and a downstream, stationary turbine component. Use of ambient pressure cooling fluids by the low pressure cooling system may result in tremendous efficiencies by eliminating the need for pressurized cooling fluids, and thus, the work required to create such fluids, for sealing the gap.

A turbine engine including the low pressure cooling system may include a turbine assembly formed from a rotor assembly. The rotor assembly may includes a plurality of rows of turbine blades extending radially outward from a rotor. The plurality of rows of turbine blades may be formed from an upstream row of turbine blades and at least one downstream row of turbine blades. The low pressure cooling system may include at least one cooling fluid supply channel with a cooling fluid exhaust outlet that is positioned downstream from at least one downstream row of turbine blades and discharges cooling fluid into a cooling fluid mixing chamber formed in part by at least one turbine blade on an upstream side of the cooling fluid mixing chamber and by at least one static structure on a downstream side. In one embodiment, the cooling fluid mixing chamber may be positioned downstream from a fourth stage row of turbine blades, where the flow path gas pressure is slightly greater than ambient. The cooling fluid exhaust outlet may be positioned such that cooling fluids exhausted from the cooling fluid exhaust outlet are directed toward the turbine blade. The cooling fluid exhaust outlet may be positioned such that cooling fluids exhausted from the cooling fluid exhaust outlet are generally aligned with a centerline of the turbine engine, thereby directing fluids towards the turbine engine. In one embodiment, the static structure may include at least a portion of a strut. In another embodiment, the cooling fluid supply channel may be contained within a strut.

The low pressure cooling system may also include at least one bleed channel having a bleed channel exhaust outlet in communication with the cooling fluid mixing chamber. The bleed channel exhaust outlet of the bleed channel may be positioned radially outward from the cooling fluid exhaust outlet of the at least one cooling fluid supply channel. Cooling fluids may be exhausted through the bleed channel exhaust outlet into the cooling fluid mixing chamber to form a pocket of cooling fluids separating a hot gas path of the turbine engine from internal aspects of the rotor assembly. The bleed channel may be in fluid communication with a compressed air source, and the compressed air source may be an internal compressor bleed at a ninth stage.

In one embodiment, the cooling fluid supply channel may be in fluid communication with one or more cooling fluid sources at or near ambient pressure such that at least one cooling fluid at or near ambient pressure is passed through the cooling fluid supply channel. The cooling fluid supply channel may include an annular plenum positioned immediately upstream from the cooling fluid exhaust outlet. One or more pre-swirlers may be positioned in the cooling fluid supply channel immediately upstream from the cooling fluid exhaust outlet and may be positioned in the annular plenum. A pre-swirler may be positioned immediately upstream from the cooling fluid exhaust outlet of the cooling fluid supply channel. In addition, a cooling fluid manifold may be in fluid communication with the cooling fluid supply channel. The cooling fluid manifold may supply cooling fluids to the cooling fluid supply channel.

The bleed channel may be positioned in a disc of the turbine blade and may extend at least partially radially outward and terminate at an outer surface of the disc radially inward from the turbine blade. In another embodiment, the bleed channel may be positioned in a disc of the turbine blade and may extend at an acute angle relative to a centerline of the turbine engine such that an outermost point of the bleed channel may be positioned closer to a row one set of turbine blades than other aspects of the bleed channel. The bleed channel exhaust outlet of the at least one bleed channel may be positioned in the disc at a dead rim cavity that is positioned between the disc and a radially inner surface of a platform of the turbine blade, thereby enabling cooling fluids flowing from the bleed channel to be directed to flow in a downstream direction that is generally aligned with a centerline of the turbine engine such that cooling fluids are exhausted into the cooling fluid mixing chamber to form a pocket of cooling fluids separating a hot gas path of the turbine engine from internal aspects of the rotor assembly.

An advantage of this invention is that the bleed channel supplies pressurized cooling fluids that seal the gap between the rotary turbine blades and the downstream static structure and create a pressure that is slightly higher than both the ambient pressure and the fourth stage turbine flow path pressure. Without this pocket of cooling fluid separation the flow path gas from the ambient cooling fluid, the pressure differential would foster ingestion of hot flow path gas into the low pressure cooling fluids from the cooling fluid supply channel.

Another advantage of this invention is that the configuration of the low pressure cooling system enables use of ambient cooling fluids, thereby resulting in tremendous savings to the turbine engine by eliminating the need to use energy to create compressed air.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figures 1, 2:
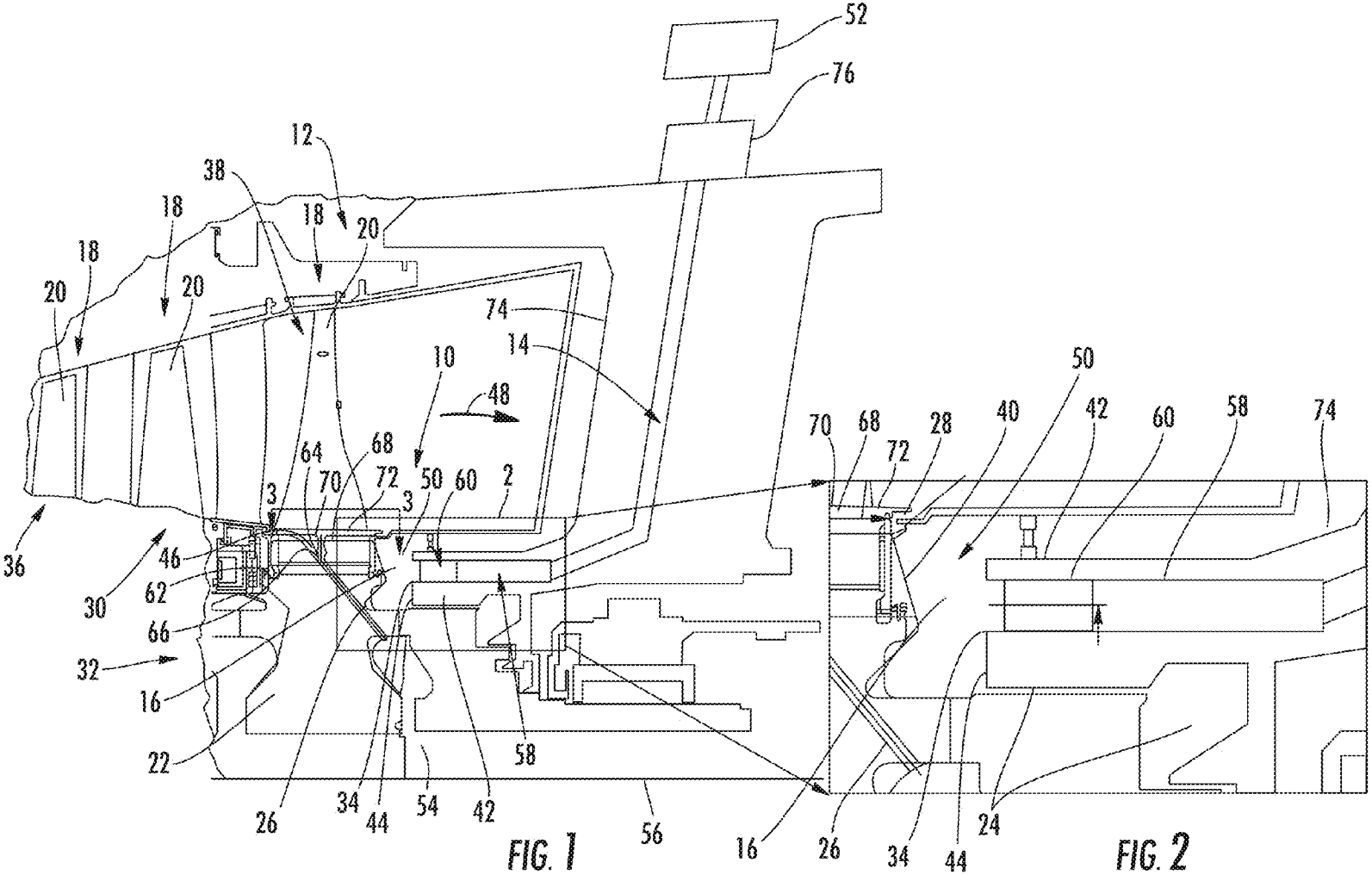
FIG. 1 is a cross-sectional side view of a portion of a turbine engine including a low pressure cooling system of this invention.
FIG. 2 is a detail view of a portion of the low pressure cooling system taken at detail 2 in FIG. 1.
Figure 3:
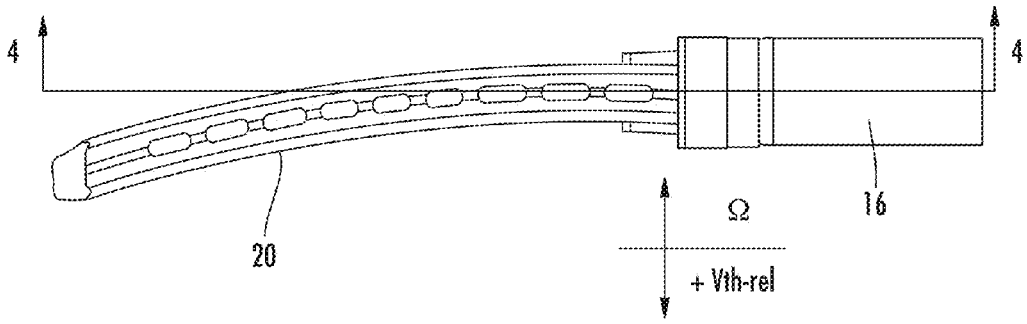
FIG. 3 is a cross-sectional view of a turbine blade taken along section line 3-3 in FIG. 1.
Figure 4:
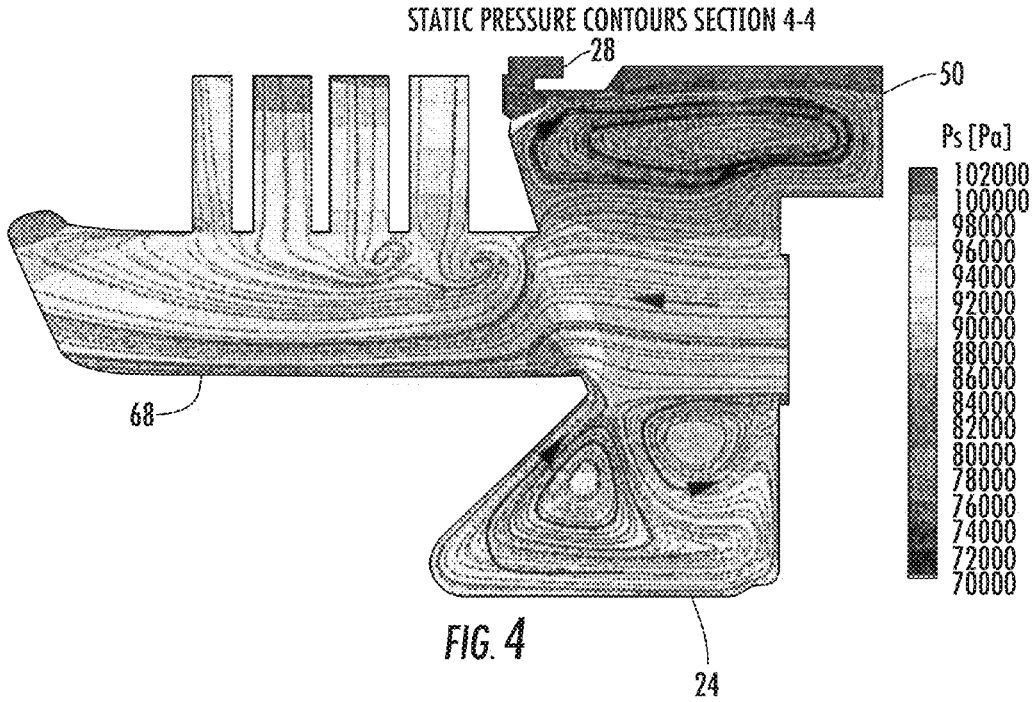
FIG. 4 is a diagram of static pressure contours in the detail view of the low pressure cooling system taken along section line 4-4 in FIG. 3.
Figure 5:
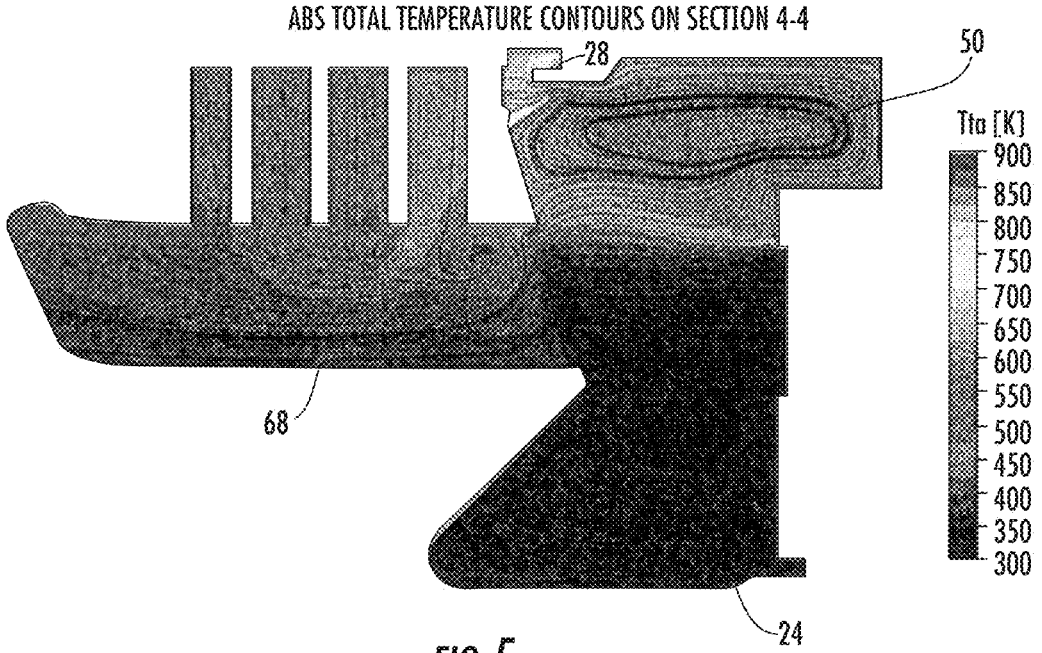
FIG. 5 is a diagram of temperature contours in the detail view of the low pressure cooling system taken along section line 4-4 in FIG. 3.
Figure 6:
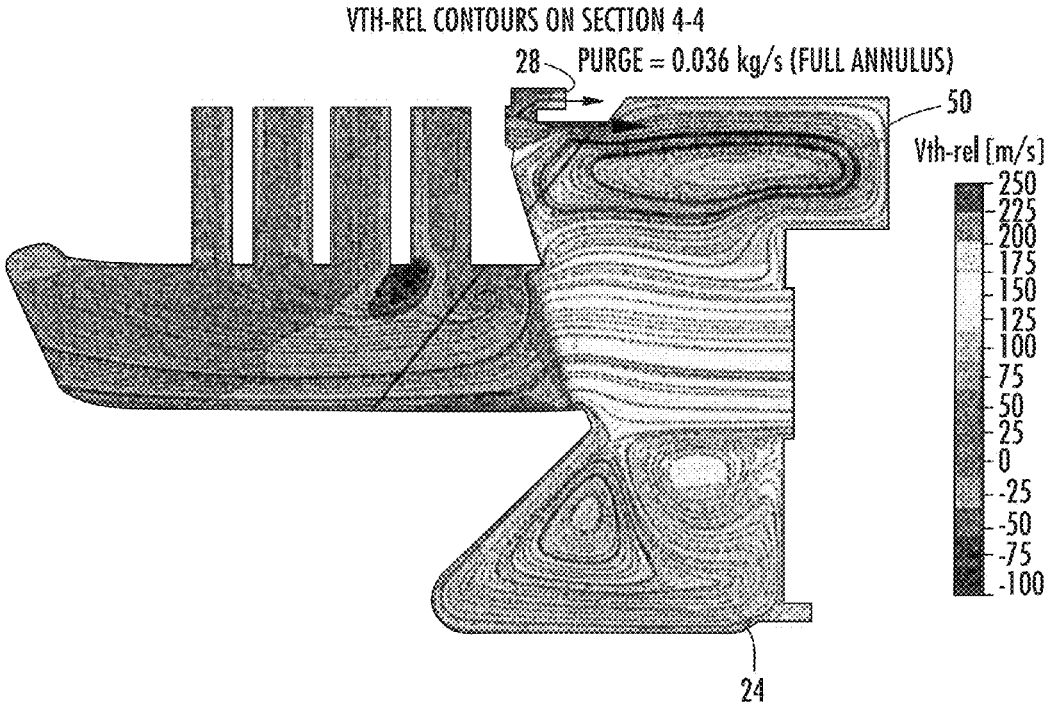
FIG. 6 is a diagram of contours of velocity of the flowing gas relative to the rotating rotors (Vth-rel) in the detail view of the low pressure cooling system taken along section line 4-4 in FIG. 3.

As shown in FIGS. 1-8, this invention is directed to a low pressure cooling system 10 for a turbine engine 12 for directing cooling fluids at low pressure, such as at or near ambient pressure, through one or more cooling fluid supply channels 14 and into a cooling fluid mixing chamber 16 positioned immediately downstream from a row 18 of turbine blades 20 extending radially outward from a rotor assembly 22 to prevent ingestion of hot gases into internal aspects 24 of the rotor assembly 22 and blades 20. The low pressure cooling system 10 may also include one or more bleed channels 26 that may extend through the rotor assembly 22 and exhaust cooling fluids into the cooling fluid mixing chamber 16 to seal a gap 28 between the rotational turbine blades 20 and a downstream, stationary turbine component 30. Use of ambient pressure cooling fluids by the low pressure cooling system 10 may result in tremendous efficiencies by eliminating the need for pressurized cooling fluids and eliminating the work required to create such fluids, for sealing the gap 28.

As shown in FIG. 1, the turbine engine 12 may be formed from one or more blade disc assemblies 32 formed into the rotor assembly 22. The rotor assembly 22 may have any appropriate configuration and may include a plurality of rows 18 of turbine blades 20 extending radially outward from a blade disc assembly 32. The plurality of rows 18 of turbine blades 20 may be formed from an upstream row 36 of turbine blades 20 and one or more downstream rows 38 of turbine blades 20. In at least one embodiment, the low pressure cooling system may be used to prevent the ingestion of hot gases through the gap 28 immediately downstream of a fourth row, otherwise referred to a fourth stage, of turbine blades 20.

The low pressure cooling system 10 may include one or more cooling fluid supply channels 14 with a cooling fluid exhaust outlet 34 that is positioned downstream from at least one downstream row 38 of turbine blades 20 and discharges cooling fluid into a cooling fluid mixing chamber 16 formed in part by at least one turbine blade 20 on an upstream side 40 of the cooling fluid mixing chamber 16 and by one or more static structures 42 on a downstream side 44. In one embodiment, the cooling fluid supply channel 14 may extend partially through the static structure 42. The static structure 42 may be, but is not limited to being, a strut, as shown in FIG. 1. The cooling fluid supply channel 14 may be in fluid communication with one or more cooling fluid sources 52 at ambient pressure such that one or more cooling fluids at ambient pressure is passed through the cooling fluid supply channel 14. The cooling fluid supply channel 14 may be positioned in static aspects of the turbine engine 12. In one embodiment, the static structure 42 may be at least a portion of a strut 74. In another embodiment, the cooling fluid supply channel 14 may be contained completely within the strut 74. The low pressure cooling system 10 may also include a cooling fluid manifold 76 in fluid communication with the cooling fluid supply channel 14, wherein the cooling fluid manifold 76 supplies cooling fluids to the cooling fluid supply channel 14.

The low pressure cooling system 10 may also include one or more bleed channels 26 having a bleed channel exhaust outlet 46 in communication with the cooling fluid mixing chamber 16 to exhaust pressurized cooling fluids at the gap 28 to prevent hot gas ingestion into internal aspects 24 of the rotor assembly 22 and blades 20. The bleed channel 26 may include a bleed channel exhaust outlet 46 positioned radially outward from the cooling fluid exhaust outlet 34 of the cooling fluid supply channel 14. As such, when cooling fluids are exhausted through the bleed channel exhaust outlet 46 into the cooling fluid mixing chamber 16, a pocket 50 of cooling fluids form within the cooling fluid mixing chamber 16 at the gap 28, thereby separating a hot gas path 48 of the turbine engine 12 from internal aspects 24 of the rotor assembly 22 and blades 20. The pocket 50 of cooling fluids together with the bleed cooling fluids directed into the gap 28 prevent the ingestion of hot gases into internal aspects 24 of the rotor assembly 22 and blades 20. The bleed channel 26 may be in fluid communication with a compressed air source 54. In one embodiment, the compressed air source 54 may be a ninth stage internal compressor bleed.

As shown in FIG. 1, the cooling fluid exhaust outlet 34 may be positioned such that cooling fluids exhausted from the cooling fluid exhaust outlet 34 are directed toward the turbine blade 20. In one embodiment, the cooling fluid exhaust outlet 34 may be positioned such that cooling fluids exhausted from the cooling fluid exhaust outlet 34 are generally aligned with a centerline 56 of the turbine engine 34. In such an embodiment, the cooling fluids flow in an opposite direction relative to the pressurized cooling fluids flowing from the bleed channel 26 shown in FIG. 1, which optimizes sealing of the gap 28.

As shown in FIGS. 1 and 2, the cooling fluid supply channel 14 may include an annular plenum 58 positioned in the cooling fluid supply channel 14 immediately upstream from the cooling fluid exhaust outlet 34. In at least one embodiment, one or more pre-swirlers 60 may be positioned in the annular plenum 58 immediately upstream from the cooling fluid exhaust outlet 34 of the cooling fluid supply channel 14. The pre-swirler 60 may have any appropriate configuration and may be formed from a plurality of blades extending radially outward and spaced circumferentially in the annular plenum 58 to redirect the cooling fluids. The pre-swirler 60 may be positioned in the cooling fluid supply channel 14 immediately upstream from the cooling fluid exhaust outlet 34.

Figure 8:
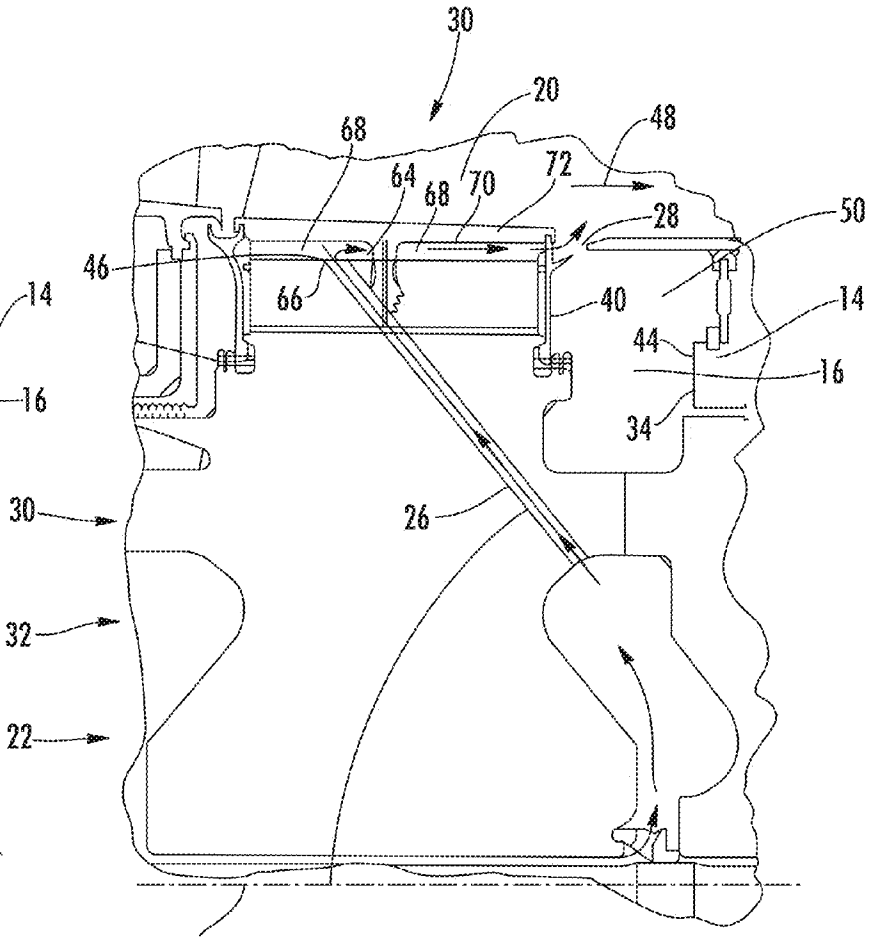
FIG. 8 is a cross-sectional side view of a portion of a turbine engine including the low pressure cooling system with an alternative bleed channel.
Figure 7:
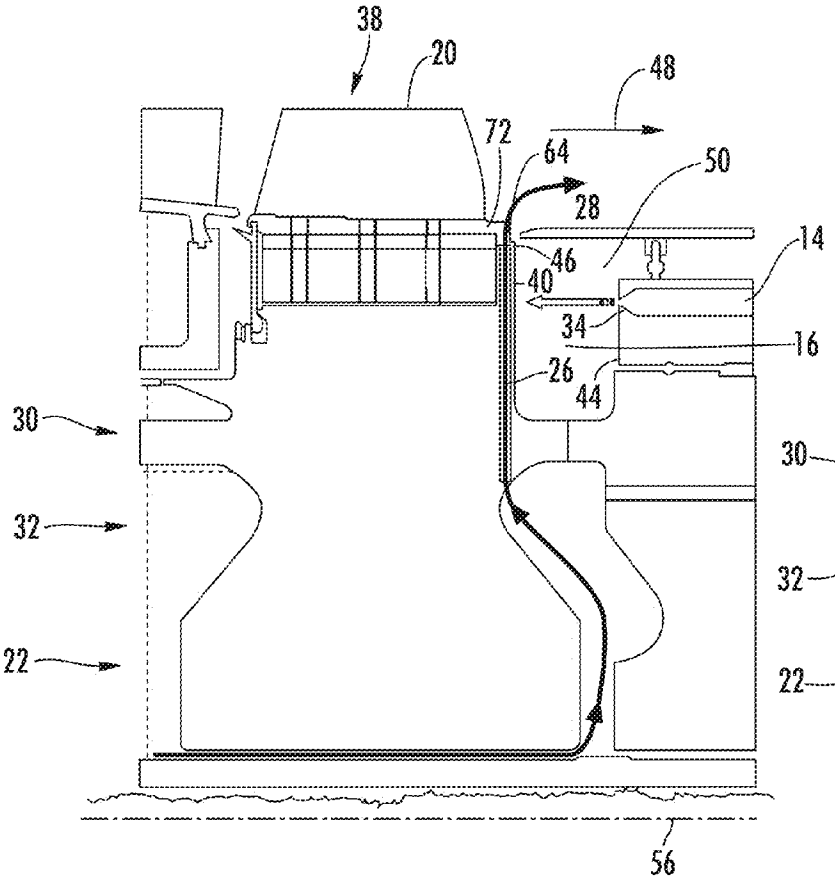
FIG. 7 is a cross-sectional side view of a portion of a turbine engine including the low pressure cooling system with a bleed channel.

As shown in FIGS. 1, 7 and 8, the bleed channel 26 may be positioned in a disc 62 of the turbine blade 20 may extend at least partially radially outward and terminate at an outer surface 64 of the disc 62 radially inward from the turbine blade 20. As shown in FIG. 7, the bleed channel 26 may extend radially outward and terminate at the gap 28 with fluid being directed radially outward. In another embodiment, as shown in FIG. 8, the bleed channel 26 may be positioned in a disc 62 of the turbine blade 20 and may extend at an acute angle relative to the centerline 56 of the turbine engine 12 such that an outermost point 66 of the bleed channel 26 is positioned closer to the upstream row 36 of turbine blades 20 than other aspects of the bleed channel 26. The bleed channel exhaust outlet 46 of the bleed channel 26 may be positioned in the disc 62 at a dead rim cavity 68 that is positioned between the disc 62 and a radially inner surface 70 of a platform 72 of the turbine blade 20. Positioning the bleed channel exhaust outlet 46 into the dead rim cavity 68 enables cooling fluids to be directed to flow in a downstream direction that is generally aligned with the centerline 56 of the turbine engine 12 such that cooling fluids are exhausted into the cooling fluid mixing chamber 16 to form a pocket 50 of cooling fluids separating a hot gas path 48 of the turbine engine 12 from internal aspects of the rotor assembly 22.

During use, cooling fluids, such as, but not limited to, air, may flow from a compressor (not shown) through the bleed channel 26 and may be exhausted at the gap 28, as shown in FIG. 7, such that hot gases from the hot gas path 48 are prevented from being ingested into the cooling fluid mixing chamber and the internal aspects 24 of the rotor assembly 22 and blades 20. In an alternative embodiment, as shown in FIGS. 1 and 8, cooling fluids may flow from the compressor through the bleed channel 26 and may be exhausted into the dead rim cavity 68 radially inward from the platform 72. The cooling fluids may then be directed to flow in a direction that is aligned with the centerline 56 of the turbine engine 12 and flow to the gap 28, where the hot gases from the hot gas path 48 are prevented from being ingested into the cooling fluid mixing chamber 16 and the internal aspects 24 of the rotor assembly 22 and blades 20. The effectiveness of the low pressure cooling system 10 is shown in FIGS. 3-6, in which formation of the pocket 50 that protects the internal aspects 24 of the rotor assembly 22 from hot gases is clearly shown.

Low pressure cooling fluids may flow through the cooling fluid manifold 76 and into one or more cooling fluid supply channels 14. The cooling fluid supply channel 14 directs the cooling fluids through the pre-swirler 60 and exhausts the cooling fluids through the cooling fluid exhaust outlet 34 into the cooling fluid mixing chamber 16. The cooling fluids are directed to flow in the direction of rotation of the turbine blades 20. The cooling fluids in the cooling fluid mixing chamber 16 form a pocket of low pressure cooling fluids that are drawn into the cooling fluid mixing chamber 16 by the slightly lower pressure that exists in the cooling fluid mixing chamber 16 because of the pressurized bleed air flowing through a portion of the cooling fluid mixing chamber 16 and into the gap 28. Thus, such a configuration prevents hot gases from the hot gas path 48 from being ingested into the cooling fluid mixing chamber 16 and into the internal aspects 24 of the rotor assembly 22 and blades 20.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine engine, comprising:

at least one turbine assembly formed from a rotor assembly, wherein the rotor assembly includes a plurality of rows of turbine blades extending radially outward from a rotor, wherein the plurality of rows of turbine blades are formed from an upstream row of turbine blades and at least one downstream row of turbine blades;

at least one low pressure cooling system including:

at least one cooling fluid supply channel with a cooling fluid exhaust outlet that is positioned downstream from at least one downstream row of turbine blades and discharges cooling fluid into a cooling fluid mixing chamber formed in part by at least one turbine blade on an upstream side of the cooling fluid mixing chamber and by at least one static structure on a downstream side;

at least one bleed channel having a bleed channel exhaust outlet in communication with the cooling fluid mixing chamber, wherein the bleed channel exhaust outlet of the at least one bleed channel is positioned radially outward from the cooling fluid exhaust outlet of the at least one cooling fluid supply channel, wherein cooling fluids are exhausted through the bleed channel exhaust outlet into the cooling fluid mixing chamber to form a pocket of cooling fluids separating a hot gas path of the turbine engine from internal aspects of the rotor assembly.

2. The turbine engine of claim 1, wherein the at least one cooling fluid supply channel is in fluid communication with at least one cooling fluid source at ambient pressure such that at least one cooling fluid at ambient pressure is passed through the at least one cooling fluid supply channel.

3. The turbine engine of claim 1, wherein the at least one bleed channel is in fluid communication with a compressed air source.

4. The turbine engine of claim 3, wherein the compressed air source is an internal compressor bleed at a ninth stage.

5. The turbine engine of claim 1, wherein the cooling fluid mixing chamber is positioned downstream from a fourth stage row of turbine blades.

6. The turbine engine of claim 1, wherein the cooling fluid exhaust outlet is positioned such that cooling fluids exhausted from the cooling fluid exhaust outlet are directed toward the at least one turbine blade.

7. The turbine engine of claim 6, wherein the cooling fluid exhaust outlet is positioned such that cooling fluids exhausted from the cooling fluid exhaust outlet are generally aligned with a centerline of the turbine engine.

8. The turbine engine of claim 1, wherein the at least one cooling fluid supply channel includes an annular plenum positioned immediately upstream from the cooling fluid exhaust outlet.

9. The turbine engine of claim 8, further comprising at least one pre-swirler positioned immediately upstream from the cooling fluid exhaust outlet of the at least one cooling fluid supply channel and positioned in the annular plenum.

10. The turbine engine of claim 1, further comprising at least one pre-swirler positioned immediately upstream from the cooling fluid exhaust outlet of the at least one cooling fluid supply channel.

11. The turbine engine of claim 1, wherein the at least one static structure includes at least a portion of a strut.

12. The turbine engine of claim 1, wherein the at least one cooling fluid supply channel is contained within a strut.

13. The turbine engine of claim 1, further comprising a cooling fluid manifold in fluid communication with the at least one cooling fluid supply channel, wherein the cooling fluid manifold supplies cooling fluids to the at least one cooling fluid supply channel.

14. The turbine engine of claim 1, wherein the at least one bleed channel is positioned in a disc of the at least one turbine blade and extends at least partially radially outward and terminates at an outer surface of the disc radially inward from the at least one turbine blade.

15. The turbine engine of claim 1, wherein the at least one bleed channel is positioned in a disc of the at least one turbine blade and extends at an acute angle relative to a centerline of the turbine engine such that an outermost point of the at least one bleed channel is positioned closer to a row one set of turbine blades than other aspects of the at least one bleed channel.

16. The turbine engine of claim 15, wherein the bleed channel exhaust outlet of the at least one bleed channel is positioned in the disc at a dead rim cavity that is positioned between the disc and a radially inner surface of a platform of the at least one turbine blade, thereby enabling cooling fluids to flow from the at least one bleed channel, to be directed to flow in a downstream direction that is generally aligned with a centerline of the turbine engine such that cooling fluids are exhausted into the cooling fluid mixing chamber to form a pocket of cooling fluids separating a hot gas path of the turbine engine from internal aspects of the rotor assembly.

17. A turbine engine, comprising:

at least one turbine assembly formed from a rotor assembly, wherein the rotor assembly includes a plurality of rows of turbine blades extending radially outward from a rotor, wherein the plurality of rows of turbine blades are formed from an upstream row of turbine blades and at least one downstream row of turbine blades;

at least one low pressure cooling system including:

at least one cooling fluid supply channel with a cooling fluid exhaust outlet that is positioned downstream from at least one downstream row of turbine blades and discharges cooling fluid into a cooling fluid mixing chamber formed in part by at least one turbine blade on an upstream side of the cooling fluid mixing chamber and by at least one static structure on a downstream side;

at least one bleed channel having a bleed channel exhaust outlet in communication with the cooling fluid mixing chamber, wherein the bleed channel exhaust outlet of the at least one bleed channel is positioned radially outward from the cooling fluid exhaust outlet of the at least one cooling fluid supply channel and wherein cooling fluids are exhausted through the bleed channel exhaust outlet into the cooling fluid mixing chamber to form a pocket of cooling fluids separating a hot gas path of the turbine engine from internal aspects of the rotor assembly and blades;

wherein the cooling fluid exhaust outlet is positioned such that cooling fluids exhausted from the cooling fluid exhaust outlet are directed toward the at least one turbine blade;

wherein the at least one bleed channel is positioned in a disc of the at least one turbine blade and extends at least partially radially outward and terminates at an outer surface of the disc radially inward from the at least one turbine blade;

wherein the at least one cooling fluid supply channel is contained within a strut; and wherein the at least one cooling fluid supply channel is in fluid communication with at least one cooling fluid source at ambient pressure such that at least one cooling fluid at ambient pressure is passed through the at least one cooling fluid supply channel.

18. The turbine engine of claim 17, further comprising at least one pre-swirler positioned immediately upstream from the cooling fluid exhaust outlet of the at least one cooling fluid supply channel and positioned in an annular plenum in a downstream end of the at least one cooling fluid supply channel.

19. The turbine engine of claim 17, wherein the at least one bleed channel is positioned in a disc of the at least one turbine blade and extends at an acute angle relative to a centerline of the turbine engine such that an outermost point of the at least one bleed channel is positioned closer to a row one set of turbine blades than other aspects of the at least one bleed channel.

20. The turbine engine of claim 19, wherein the bleed channel exhaust outlet of the at least one bleed channel is positioned in the disc at a dead rim cavity that is positioned between the disc and a radially inner surface of a platform of the at least one turbine blade, thereby enabling cooling fluids to flow from the at least one bleed channel, to be directed to flow in a downstream direction that is generally aligned with a centerline of the turbine engine such that cooling fluids are exhausted into the cooling fluid mixing chamber to form a pocket of cooling fluids separating a hot gas path of the turbine engine from internal aspects of the rotor assembly.

* * * * *